United States Patent [19]

Ormili et al.

[11] 4,090,280

[45] May 23, 1978

[54] MANUFACTURE OF HELICAL WAVE GUIDES

[75] Inventors: Bernard Ormili, Lyon; Georges Comte, St Leu la Foret, both of France

[73] Assignee: Les Cables de Lyon S.A., Lyon Cedex, France

[21] Appl. No.: 763,627

[22] Filed: Jan. 28, 1977

[30] Foreign Application Priority Data

Feb. 5, 1976 France ..... 76 03209

[51] Int. Cl.[2] ..... H01P 11/00

[52] U.S. Cl. ..... 29/33 K; 29/600

[58] Field of Search ..... 29/600, 469.5, 564.1, 29/33 K; 156/428, 423, 543; 425/500; 228/126, 130

[56] References Cited

U.S. PATENT DOCUMENTS

| | | | |
|---|---|---|---|
| 3,237,285 | 3/1966 | Gormley | 29/600 |
| 3,342,648 | 9/1967 | Zucker et al. | 29/424 |
| 3,500,534 | 3/1970 | Kennedy | 29/600 |
| 3,540,119 | 11/1970 | Manoly | 29/600 |
| 3,605,046 | 9/1971 | Miller | 29/600 |
| 3,845,549 | 11/1974 | Ferrentino | 29/600 |

*Primary Examiner*—Othell M. Simpson

*Attorney, Agent, or Firm*—Haseltine, Lake & Waters

[57] ABSTRACT

A machine for manufacturing circular section helical wave-guides and providing simultaneous calibration of the bore of the helix and snug fitting of the screen around the helix. The helix is loosely fitted in an enveloping tube and both tube and helix are drawn through a reducing die for drawing the tube down onto the helix. The bore of the helix is established by a mandrel and the outer surface of the helix is softened just before entering the die whereby the helix is welded to the inner surface of the tube.

2 Claims, 1 Drawing Figure

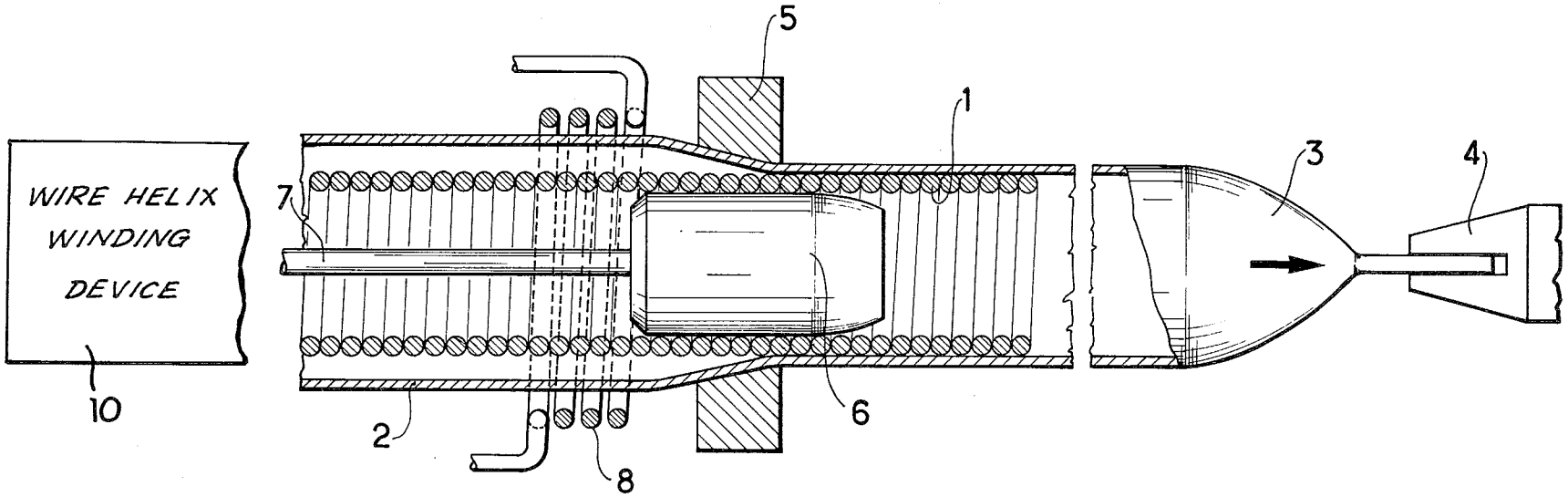
4
3
1
5
6
8
2
7
WIRE HELIX
WINDING
DEVICE
10

MANUFACTURE OF HELICAL WAVE GUIDES

BACKGROUND OF THE INVENTION

The present invention relates to an improvement of a machine for manufacturing circular section helical wave guides for transmission of electromagnetic energy in the circular TE 01 mode in preference, to the exclusion of all other modes.

A known type of machine for manufacturing such wave guides employs a first manufacturing phase in which a helical conductor is made by welding turn by turn of a helix formed from a conductor wire which has a covering of low loss material. In a second phase this helix is inserted into a conductive metal envelope which serves as a screen for the guide, the envelope being drawn down around the helix in such a manner as to hold the turns in place with very slight play to avoid altering their inner diameter.

However, a guide made according to this method suffers from drawbacks. Indeed, the separation between the screen and the helix introduces an eccentricity which results in a lowering of the maximum operating frequency. Further, when the guide is curved to change direction during laying, part of the electromagnetic energy leaks through the turns and the eccentricity reduces the uniformity of transmission by the helix.

Preferred embodiments of the machine according to the present invention reduce this drawback. Indeed it is possible to arrange at the same time both for the inner surface of the helix to be uniform and for the metal envelope to be brought into close contact with the outer surface of the helix.

SUMMARY OF THE INVENTION

The present invention provides a machine for manufacturing circular section helical wave guides. The machine has means for winding a helix from conductor wires having a thermoplastic insulative covering, means for sliding a metal tube around the helix, a reducing die, means for drawing the tube and the helix through the die to reduce the diameter of the tube, a bore-calibrating mandrel held inside the helix where it passes through the die, and a heater disposed around the metal tube immediately upstream of the die to soften the outer surface of said helix for welding to the inner surface of the tube as they pass through the die.

Preferably the heater is a high frequency induction heater.

The present invention also provides a helical wave guide manufactured by the machine.

BRIEF DESCRIPTION OF THE DRAWING

An embodiment of the present invention is described by way of example with reference to the sole FIGURE of the accompanying drawing which is a partial section showing a die of the embodiment.

DESCRIPTION OF THE PREFERRED EMBODIMENT

The portion 10 of the machine which manufactures the helix 1 is situated at the left of the figure. The resultant helix is constituted by joined turns of a wire with a covering of a thermoplastic insulator advantageously chosen from the polyolefins such as polyethylene, polytetrafluoroethylene or polypropylene for example. A metal envelope 2 (of aluminum for example) surrounds the helix 1 with sufficient initial play for convenient insertion of the helix 1 into the envelope 2. The leading end of the metal envelope 2 tapers down in the form of a cone 3 towards an axially disposed lug which is clamped in a drawing device 4 (which may be a winch for example with a length of wire or chain connected to the drawing device 4). The envelope 2 is drawn through a reducing die 5 to reduce its cross-section. A bore-calibrating mandrel 6 of generally quasi-cylindrical or egg-shaped form is held centered inside the helix 1 and in the plane of the die 5. The mid point of the mandrel is approximately in the middle plane at right angles through the die 5. The mandrel 6 is held in position by a retaining rod 7. A lubricant may be extruded around the mandrel 6 to facilitate the sliding of the helix 1 thereover. The outside diameter of the mandrel 6 is equal to the desired internal diameter of the wave guide and the bore diameter of the die 5 is so calculated that, taking into account the diameter of the wire and its covering and the thickness of the tube after drawing, the helix and the envelope are brought into contact by the drawing operation.

A high frequency induction heating device 8 (as shown) or a flame, heats the outside of the envelope 2 before it passes into the die 5. This heating also softens the outer surface of the helix 1 and causes the outer surface of the helix 1 to be welded to the inner surface of the envelope 2 during the reducing operation. To improve this effect the insulative covering of the helix may be of a thermoadhesive material (e.g. grafted polyethylene) or alternatively the inner surface of the metal envelope 2 may be covered in advance with a thin layer of a thermoadhesive material and the welding will take place by localized melting of this material in the immediate neighborhood of the reduction zone.

A machine embodying the present invention enables the simultaneous provision in a single operation of a calibrated bore for the helix together with an external protection for the wave guide. It is intended for the manufacture of guides for transmitting waves in the circular TE 01 mode.

What we claim is:

1. A machine for manufacturing circular section helical wave guides, the machine comprising: means for winding a helix from conductor wires having a thermoplastic insulative covering, means for sliding a metal tube around said helix, a reducing die, means for drawing said tube and said helix through said die to reduce the diameter of said tube, a bore-calibrating mandrel held inside said helix where it passes through said die, and a heater disposed around said metal tube immediately upstream of said die to soften the outer surface of said helix for welding to the inner surface of said tube as they pass through said die.

2. A machine according to claim 1 wherein said heater is a high-frequency induction heater.

* * * * *